US006092535A

United States Patent [19]

Moore

[11] Patent Number: 6,092,535

[45] Date of Patent: Jul. 25, 2000

[54] DUAL PURPOSE HAIR COLORING TOOL

[75] Inventor: Lisa Moore, Olathe, Kans.

[73] Assignee: LLMI, Inc., Olathe, Kans.

[21] Appl. No.: 09/185,298

[22] Filed: Nov. 3, 1998

[51] Int. Cl.[7] ..... A45D 7/02; A45D 19/18; A45D 44/18

[52] U.S. Cl. ..... 132/270; 132/313; 132/212

[58] Field of Search ..... 132/270, 120, 132/121, 313, 150, 308, 310, 290, 212; 15/167.1

[56] References Cited

U.S. PATENT DOCUMENTS

| | | | |
|---|---|---|---|
| D. 370,783 | 6/1996 | Korte | 132/270 |
| 2,243,774 | 5/1941 | Resh | 132/308 |
| 2,618,275 | 11/1952 | Pearson | 132/112 |
| 2,799,283 | 7/1957 | Kapusnyk | 132/120 |
| 3,949,765 | 4/1976 | Vallis | 132/120 |
| 4,346,496 | 8/1982 | Murray | 132/121 |
| 5,331,983 | 7/1994 | Father | 132/310 |
| 5,499,637 | 3/1996 | Foti | 132/112 |
| 5,701,920 | 12/1997 | Taylor et al. | 132/212 |

OTHER PUBLICATIONS

Photograph of conventional tooth brush marked Exhibit A.
Photograph of conventional hair coloring tool marked Exhibit B.
Photograph of conventional hair coloring tool marked Exhibit C.
Photograph of conventional hair coloring tool marked Exhibit D.
Photograph of conventional hair coloring tool marked Exhibit E.

*Primary Examiner*—John J. Wilson
*Assistant Examiner*—Robyn Kieu Doan
*Attorney, Agent, or Firm*—Hovey, Williams, Timmons & Collins

[57] ABSTRACT

A multi-purpose hair coloring tool includes an elongated body and a plurality of bristles projecting from the body adjacent one end thereof. The bristles cooperatively define a serrated brush edge spaced from the body, with the brush edge being particularly effective in applying coloring agents to the hair. Adjacent the opposite end of the body is a hook which may be used for such techniques as cap highlighting or hair weaving.

13 Claims, 1 Drawing Sheet

DUAL PURPOSE HAIR COLORING TOOL

BACKGROUND OF THE INVENTION

1. Field of the Invention

The present invention relates generally to cosmetic and beauty supplies. More particularly, the present invention concerns a hair coloring brush having an improved bristle configuration adjacent one end and a hook adjacent an opposite end for facilitating so-called "cap highlighting".

2. Discussion of Prior Art

There are several primary objectives in applying coloring agents to one's hair. For example, the coloring agent (typically in the form of a liquid, paste or gel) must be applied in a manner that creates a natural appearance. In other words, the application should have an appearance that resembles natural hair color, rather than the appearance of manual coloring. One way to enhance the natural appearance of hair coloring is to avoid lines that clearly demarcate colored hair from uncolored hair. It is also important that the coloring application be quick and inexpensive. Accordingly, the desired natural appearance should not be attained at the expense of time and money.

However, conventional hair coloring tools have proven to be ineffective in applying coloring agents in a manner that provides the desired natural appearance, without sacrificing time and expense. Most tools have a relatively straight applicator element (e.g., a row of substantially equal length bristles or a spatula-type plate with a straight distal end), and it is consequently difficult to avoid lines that demarcate colored hair from uncolored hair. That is to say, a hair coloring application with a conventional tool is tedious and requires a significant amount of experience and time.

One traditional type of hair coloring technique referred to as "cap highlighting" involves coloring of only portions of the hair. The highlighted or colored hair is typically separated from the rest of the hair by covering the hair with a plastic or foil cap and placing the portions of hair to be colored outside the cap. Such separation is traditionally accomplished by inserting a hook through the cap, hooking a portion of the person's hair, and then pulling the hook out of the cap to place the portion of hair outside of the cap. In most instances, this requires the person or beautician to manipulate two tools—the coloring agent applicator and the hooked tool. This adds additional time and difficulty to a coloring application.

OBJECTS AND SUMMARY OF THE INVENTION

Responsive to these and other problems, an important object of the present invention is to provide a hair coloring tool that is particularly effective in applying coloring agents to the hair in a manner that provides a natural appearance. It is also an important object of the present invention to provide a hair coloring tool that provides the natural appearance, without requiring skilled and overly time consuming application of the coloring agent. Another important object of the present invention to provide a multi-purpose hair coloring tool that functions as more than just an applicator of the coloring agent. In particular, it is an important object of the present invention to provide a hair coloring tool that effectively applies the coloring agent to the hair and is particularly useful in cap highlighting techniques.

In accordance with these and other objects evident from the following description of the preferred embodiment, the present invention concerns a multi-purpose hair coloring tool including an elongated body and a plurality of bristles projecting from the body adjacent one end thereof. Adjacent an opposite end of the body is a hook. In the illustrated embodiment, the bristles cooperatively present a serrated brush edge, which is particularly effective in applying coloring agents to the hair in a manner that creates a natural appearance. The hook is preferably located adjacent a tapered end of the body, such that the tapered end may be pierced through a cap and the hook may be used to pull portions of hair through the cap (e.g., during cap highlighting).

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures; wherein.

DETAILED DESCRIPTION OF THE PREFERRED EMBODIMENT

Figure 1:
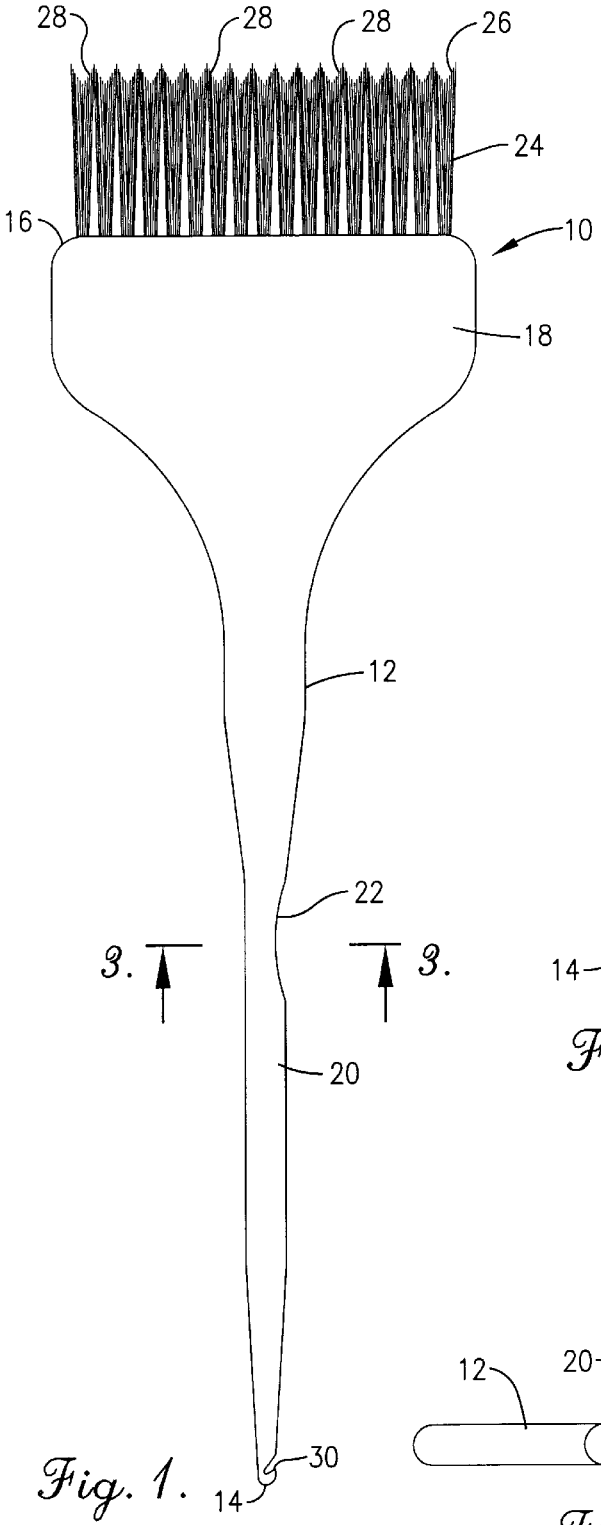
FIG. 1 is a plan view of a dual purpose hair coloring tool constructed in accordance with the principles of the present invention, particularly illustrating the serrated brush edge provided by the bristles.
Figure 3:
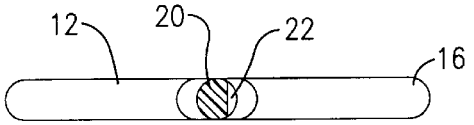
FIG. 3 is a cross-sectional view of the brush taken along line 3—3 of FIG. 1, particularly illustrating the cylindrical shape of the handle portion of the brush and the thumb indentation provided in the handle portion.

Turning initially to FIG. 1, the hair coloring tool 10 selected for illustration comprises an elongated body 12 having opposite ends 14 and 16. The body 12 tapers toward the end 14, with the end 14 being generally rounded for purposes which will subsequently be described. The body 12 is relatively larger adjacent the opposite end 16 and defines a substantially flat head 18. Extending between the end 14 and the head 18 is a handle portion 20 for facilitating gripping by the user. It is noted that the head 18 and handle portion 20 cooperatively present concavo-convex side margins of the body 12, as perhaps best shown in FIG. 1. At least part of the handle portion 20 has a cylindrically shaped outer surface (see FIG. 3), with an impression or indentation 22 extending inwardly from the outer surface. It will also be appreciated that the body 12 presents a substantially central longitudinal axis extending from the rounded end 14 to the opposite end 16.

The body 12 is formed of any suitable material, such as wood, injection molded plastic or metal. When a wood material is used, the body 12 may be stained or painted. On the other hand, when the body 12 is formed of a plastic material, a pigment may be added prior to molding for providing the desired coloring. It is noted that the flat head 18 is well suited for indicia, such as a trademark or advertising.

Projecting from the large end 16 of the body 12 are a plurality of flexible bristles 24 arranged in a single row of separate tufts spaced across the head 18. As shown in FIG.

Figure 2:
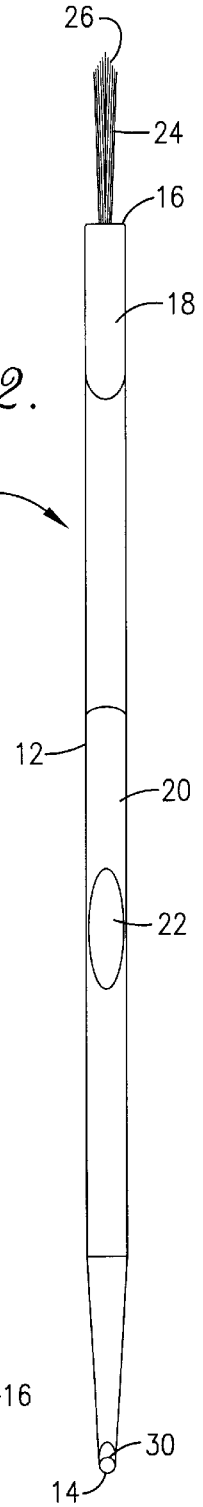
FIG. 2 is a side elevational view of the brush shown in FIG. 1.

1, the bristles 24 cooperatively define an outermost serrated brush edge 26 spaced from the head 18. In the illustrated embodiment, the serrated edge 26 is created by a V-shaped notch 28 extending inwardly from the distal end of each tuft. In the side profile, the illustrated bristles 24 of each tuft converge toward an outermost, central point (see FIG. 2). Each illustrated tuft of bristles has a proximal end (not shown) fixed by suitable means (e.g., glue) within a cylindrical opening (also not shown) extending into the head 18. It is also noted that the preferred tufts have generally the same overall length.

However, it is entirely within the ambit of the present invention to provide the tool 10 with various other bristle arrangements. For example, the undulating brush edge 26 may alternatively be formed by bristles arranged in tufts having inverted V-shaped distal ends (similar to that shown in FIG. 2), such that the notches of the serrated edge are defined by adjacent tufts rather than each individual tuft. In addition, each pair of adjacent tufts may be formed by a single set of bristles, with the set of bristles looping through the head 18 to form the adjacent tufts. In addition, more than one row of tufts may be provided, if desired.

Figure 4:
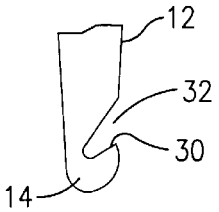
FIG. 4 is an enlarged, fragmentary side elevational view of the rounded end of the brush, particularly illustrating the configuration of the hook.

Adjacent the rounded end 14 of the body 12 is a hook 30 which is preferably defined by a generally V-shaped groove 32 extending obliquely inward from the outer surface of the body 12, as perhaps best shown in FIG. 4. It is noted that the groove 32 projects generally toward the rounded end 14. In addition, the groove 32 and the indentation 22 extend inwardly in generally the same direction toward the central axis of the body 12. This corresponding configuration improves handling and ensures correct positioning of the tool 10. Specifically, the user may place his/her thumb in the indentation 22 and cause the hook 30 to catch items, such as strands of hair, with simple and comfortable hand strokes.

The tool 10 is grasped along the handle portion 20 while using either the improved applicator brush defined by the bristles 24 or the hook 30. With particular respect to the applicator brush, it has been determined that the serrated brush edge 26 applies coloring agents to the hair in a manner that creates a natural appearance. That is to say, unwanted lines of demarcation are avoided, without requiring a significant amount of time or skilled application. As noted above, the hook 30 may be used in cap highlighting techniques. Particularly, the rounded end 14 may be pierced through a cap (such penetration being facilitated by the tapered nature of the body 12), and the hook 30 may be used to gather and pull portions of hair through the cap. The end 14 is rounded so as to provide a blunt surface for reducing the risk of injury to the scalp when the body 12 is pierced through the cap. In these respects, the tool 10 is particularly useful in applying hair coloring agents to the hair and facilitating cap highlighting. The hook 30 may also be used for various other purposes, such as hair weaving.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states her intent to rely on the Doctrine of Equivalents to determine and assess the reasonably fair scope of the present invention as pertains to any apparatus not materially departing from but outside the literal scope of the invention as set forth in the following claims.

What is claimed is:

1. A multi-purpose hair coloring tool comprising:

an elongated body presenting opposite first and second ends;

a hook adjacent the first end of the body; and a plurality of flexible bristles projecting from the body adjacent the second end thereof, said bristles cooperatively defining an outermost, undulating brush edge spaced from the body.

2. A multi-purpose hair coloring tool as claimed in claim 1, said bristles being arranged into a plurality of separate tufts projecting from the body.

3. A multi-purpose hair coloring tool as claimed in claim 2, said body including a generally flat head adjacent said second end, said tufts projecting from the head and being spaced apart along a single row extending across said head.

4. A multi-purpose hair coloring tool as claimed in claim 2, each of said tufts having a generally V-shaped distal end.

5. A multi-purpose hair coloring tool as claimed in claim 2, each of said tufts having a distal end and a V-shaped notch extending inwardly from said distal end.

6. A multi-purpose hair coloring tool as claimed in claim 1, said body including a handle portion extending between said first and second ends.

7. A multi-purpose hair coloring tool as claimed in claim 6, said body presenting an outer surface, said handle portion including an indentation extending inwardly from the outer surface of the body.

8. A multi-purpose hair coloring tool as claimed in claim 7, said hook being defined by a generally V-shaped groove extending obliquely inward from the outer surface of the body adjacent the first end.

9. A multi-purpose hair coloring tool as claimed in claim 8, said body presenting a substantially central, longitudinal axis, said indentation and said groove projecting inwardly in generally the same direction toward said axis.

10. A multi-purpose hair coloring tool as claimed in claim 1, said body tapering toward said first end.

11. A multi-purpose hair coloring tool as claimed in claim 9 said body being rounded at its first end.

12. A multi-purpose hair coloring tool as claimed in claim 1, said body presenting an outer surface, said hook being defined by a generally V-shaped groove extending obliquely inward from the outer surface of the body adjacent the first end.

13. A multi-purpose hair coloring tool as claimed in claim 1, said bristles being arranged in a generally linear row presenting opposite sides, said serrated brush edge extending from one of the sides to the other.

* * * * *